US006880764B2

(12) United States Patent
Schwarzbich

(10) Patent No.: US 6,880,764 B2
(45) Date of Patent: Apr. 19, 2005

(54) FIXING DEVICE FOR RAILWAY RAILS

(76) Inventor: Jörg Schwarzbich, Wertherstrasse 15, Bielefeld (DE), 33615

( * ) Notice: Subject to any disclaimer, the term of this patent is extended or adjusted under 35 U.S.C. 154(b) by 0 days.

(21) Appl. No.: 10/469,863

(22) PCT Filed: Feb. 26, 2002

(86) PCT No.: PCT/EP02/02001

§ 371 (c)(1),
(2), (4) Date: Sep. 5, 2003

(87) PCT Pub. No.: WO02/079575

PCT Pub. Date: Oct. 10, 2002

(65) Prior Publication Data

US 2004/0084548 A1 May 6, 2004

(30) Foreign Application Priority Data

Mar. 31, 2001 (DE) ..... 201 05 698 U

(51) Int. Cl.[7] ..... E01B 3/12
(52) U.S. Cl. ..... 238/287; 238/283

(58) Field of Search ..... 238/264, 283, 238/284, 287, 292, 297, 310, 315

(56) References Cited

U.S. PATENT DOCUMENTS

| | | | | |
|---|---|---|---|---|
| 4,150,791 A | | 4/1979 | Reynolds et al. | |
| 4,316,578 A | | 2/1982 | Reynolds et al. | |
| 4,715,533 A | * | 12/1987 | Bucksbee et al. | 238/283 |
| 5,203,501 A | * | 4/1993 | Vanotti | 238/265 |
| 5,549,245 A | * | 8/1996 | Kish | 238/283 |

FOREIGN PATENT DOCUMENTS

| | | |
|---|---|---|
| FR | 786072 | 8/1935 |

* cited by examiner

*Primary Examiner*—S. Joseph Morano
*Assistant Examiner*—Robert J. McCarry, Jr.
(74) *Attorney, Agent, or Firm*—Richard M. Goldberg

(57) ABSTRACT

Fixing device for railway rails, including a ribbed plate which supports the rail, is to be fixed on a rail substructure, and has ribs between which the rail is accommodated with its rail base, with the ribbed plate being a drawn sheet member.

15 Claims, 3 Drawing Sheets

FIXING DEVICE FOR RAILWAY RAILS

BACKGROUND OF THE INVENTION

The invention relates to a fixing device for railway rails, comprising a ribbed plate which supports the rail, is to be fixed on a rail substructure and has ribs between which a rail is accommodated with its rail base.

In conventional fixing devices of this type, the ribbed plate is anchored on rail ties made of wood or concrete, for example by means of bolts. The ribs projecting from the ribbed plate on both sides of the rail base define the lateral position of the rail. An adjusting device, formed, for example, by eccentrics with which the bolts are journalled in the ribbed plate, permits a lateral adjustment of the rail. The rail base is surmounted on both sides by strong clamping springs which clamp the rail base against the ribbed plate. The clamping springs themselves are fixed on the ribbed plate, for example by means of hammerhead bolts which are anchored on or in the ribbed plate and extend each through a loop portion of the clamping spring, so that the clamping spring can be biased by means of a nut screwed onto the hammerhead bolt. Then, the ribbed plate also forms a seat for the clamping springs. Frequently, a noise and vibration absorbing intermediate layer is provided underneath the ribbed plate, and an inlay of noise and vibration absorbing material may also be provided between the ribbed plate and the rail base.

Heretofore, the ribbed plate has been formed by a massive steel member, e.g. a member made of cast steel. However, due to the numerous functions the rib plate has to fulfill, it must have a relatively complex shape, so that the manufacture of the ribbed plate is relatively expensive.

SUMMARY OF THE INVENTION

It is an object of the invention to provide a cheaper fixing device which permits a safe and simple fixing of the railway rails on the rail substructure.

According to the invention, this object is achieved by the feature that the ribbed plate is a drawn sheet member.

According to the invention, the various functional components of the ribbed plate, in particular the ribs for positioning the rail base and, as the case may be, the seats for the clamping springs, the structures accommodating the hammerhead bolts or other means for biasing the clamping springs, as well as holes or journals for the bolts or the adjusting device, are thus formed in an efficient way by drawing a one-piece sheet member. Thus, the costs and the material consumption for the ribbed plate are lowered significantly, and the required functional components of the ribbed plate can be formed precisely in the desired shape by drawing.

Advantageous embodiments of the invention are indicated in the dependent claims.

Preferably, the ribbed plate is shaped as a downwardly open shell the cavity of which is filled with a vibration absorbing material, e.g. synthetic resin.

In a particularly preferred embodiment, the cavity of the shell is filled with synthetic resin by injection molding, so that the ribbed plate and the material filling the cavity thereof form a composite material. The filling material has not only vibration absorbing properties but also provides a desirable increase in the stiffness of the drawn ribbed plate.

If a vibration absorbing intermediate layer is provided below the ribbed plate, this layer can also be molded to be ribbed plate and, in a particularly useful embodiment, can be formed in one piece with the material filling the ribbed plate. Similarly, a vibration absorbing inlay on the top side of the ribbed plate, in the space between the ribs, can be molded in the same process.

The ribs preferably have the form of elongated, essentially truncated pyramid-shaped protuberances and may at the same time be configured as anchoring sites for the hammerhead bolts or other fastening means for the clamping springs. Optionally, the anchoring sites for the hammerhead bolts and the like may also be formed separately of the ribs in the drawn ribbed plate. Perforations for the hammerhead bolts, normal bolts or other fastening means may be formed by corresponding punched recesses in the ribbed plate and can be formed concurrently with the drawing process by means of a suitable drawing and punching tool.

If an adjusting device formed by eccentrics for the lateral adjustment of the rail is provided, the bearings for the eccentrics are formed by drawn sleeves formed in one piece with the ribbed plate.

Typically, the support face which is formed between the ribs on the top side of the ribbed plate and supports the rail base, is not exactly horizontal but has a certain slope. In the device according to the invention, this may also be achieved by giving the ribbed plate a suitable, generally wedge-like shape in the drawing process.

In DE-U-201 02 160, the applicant has proposed an apparatus for adjusting a rail on a rail substructure, which also permits a height adjustment of the rail. Optionally, the ribbed plate described herein may also be part of such an adjusting device.

BRIEF DESCRIPTION OF THE DRAWINGS

Embodiment examples will now be described in greater detail in conjunction with the drawings, in which.

DETAILED DESCRIPTION

Figure 1:
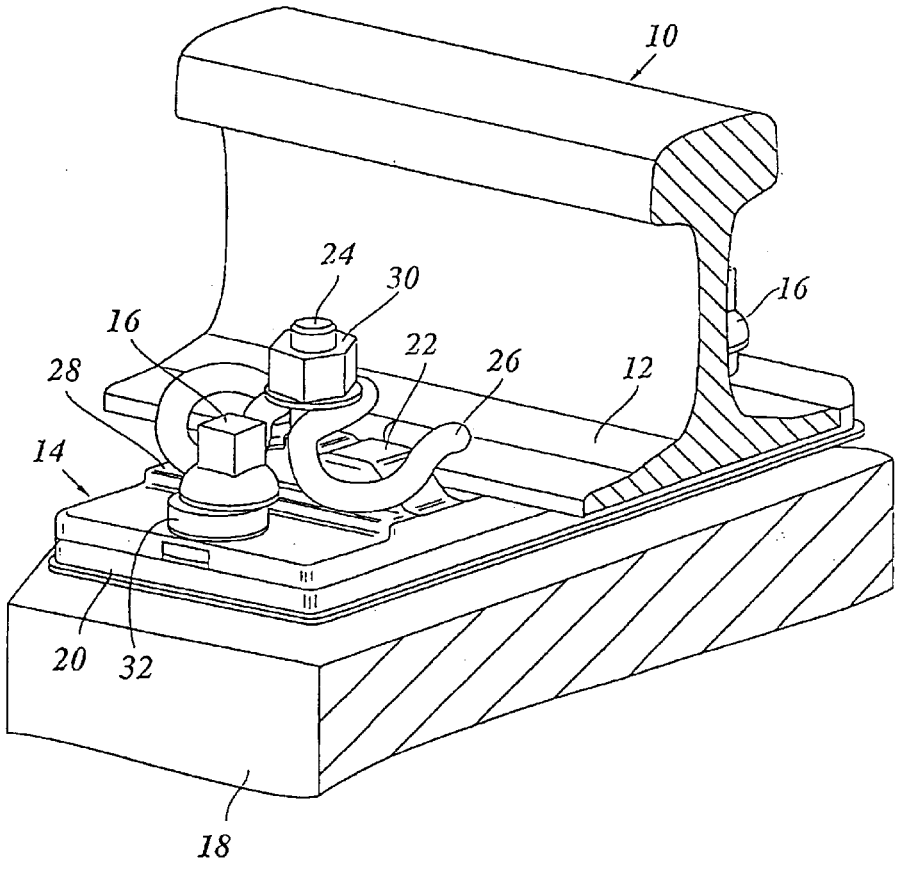
FIG. 1 is a perspective view of a fixing device for a railway rail.

FIG. 1 shows a section of a rail 10 which is supported with its rail base 12 on a ribbed plate 14. The ribbed plate 14 is itself fixed on a rail substructure 18, which is formed by a flat, continuous concrete rail bed in the shown example, by means of bolts 16 of which only the heads are visible in FIG. 1. An intermediate layer 20 made of a noise and vibration absorbing material is interposed between the ribbed plate 14 and the rail substructure 18.

The ribbed plate 14 is formed by a deep-drawn member of sheet metal shaped as a downwardly open shell and is provided on its top side with two raised ribs 22 shaped as truncated pyramids with slightly rounded edges, which accommodate the rail base 12 therebetween and thereby define the lateral position of the rail 10. A hammerhead bolt 24 which passes through a clamping spring 26 of a known construction is anchored in each rib 22. In a position which, in transverse direction of the rail 10, is further to the outside than the position of the hammerhead bolt 24, the clamping spring 26 is supported on a platform 28 formed by the ribbed plate 14, and the clamping spring 26 is firmly pressed against the rail base 12 by a nut 30 which is screwed onto the hammerhead bolt 24.

Each of the bolts 16 passes through an eccentric 32 which is rotatably supported in a bearing formed by the ribbed plate 14. The eccentrics 32 form an adjusting device which enables an adjustment of the ribbed plate 14 and hence of the rail 10 relative to the bolts 16 and the rail substructure 18 in transverse direction.

Figure 2:
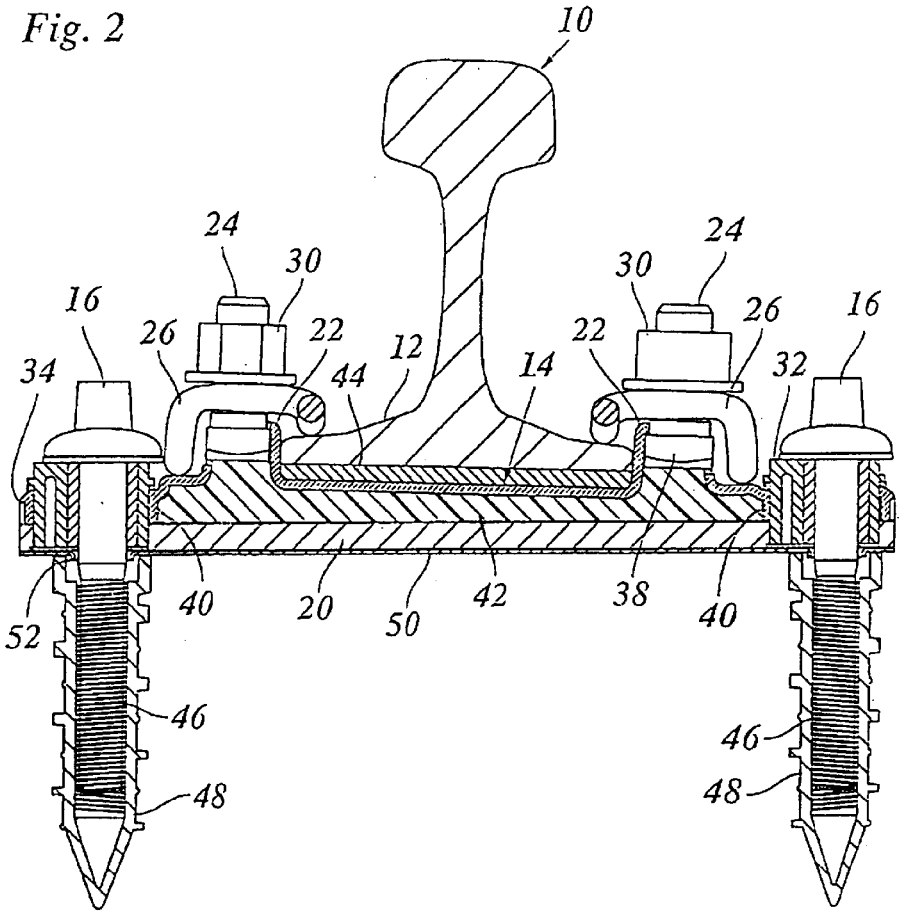
FIG. 2 is a sectional view of the fixing device and the associated rail.
Figure 3:
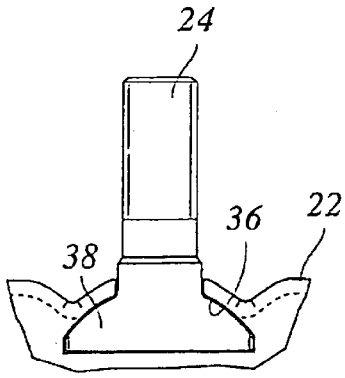
FIG. 3 is a detail showing a rib of a ribbed plate and a hammerhead bolt anchored in the ribbed plate.

In the sectional view in FIG. 2, the exact shape of the deep-drawn ribbed plate 14 can be seen more clearly. This ribbed plate has a peripheral rim 34 with which it is supported on the intermediate layer 20. Thus, the ribbed plate has the general shape of a downwardly open shell from which the ribs 22 have been pressed-out upwardly in the deep-drawing process. At the level of the section plane in FIG. 2, each of the ribs 22 has a perforation 36 on its top side and its outer side, which perforation has been punched out in the drawing process and permits the head 38 of the hammerhead bolt 24 to be hooked-in, as is shown in FIG. 3. The head 38 of the hammerhead bolt has a cross-sectional shape of a segment of a circle, as seen in FIG. 3, and the top wall of the rib 22 has been shaped in the deep-drawing process such that it assumes a shape complementary to the cross section of the head, so that the hammerhead bolt 24 can easily be centered.

As is further shown in FIG. 2, bearing bushes 40 for the eccentrics 32 are formed by cylindrical sleeves which are downwardly drawn-in the drawing process of the ribbed plate 14 and the bottom of which has been punched-out and removed.

The bearing bushes 40 also have a rim supported on the intermediate layer 20.

The interior of the shell-shaped ribbed plate 14 is filled with a lining 42 of a preferably elastic synthetic material, e.g. synthetic resin. The lining 42 is preferably formed by integrally molding the synthetic resin to the shell-like ribbed plate 14 in an injection molding process. Similarly, a noise and vibration absorbing inlay 44 of synthetic resin may be molded to the tope side of the ribbed plate 14 in the portion between the two ribs 22.

While the intermediate layer 20 has a uniform thickens and supports the lower rim of the ribbed plate 14 in a horizontal position, the top side of the ribbed plate 14 covered by the inlay 44 is slightly sloping to the right in FIG. 2, so that the rail 10 is supported on the ribbed plate 14 in a slightly inclined position, as is conventional.

By the lining 42, the ribbed plate 14 is stiffened such that it can stably bear the weight of the rail 10 and the railway car traveling thereon. The lining 42 fills the interior of the shell-like ribbed plate 14 completely, with the exception of recesses in the portions of the ribs 22 which accommodate the heads 38 of the hammerhead bolts 24. Each of the bolts 16 is rotatably supported in the associated eccentric 32 with a non-threaded shaft and has, below this shaft, a threaded portion 46 with which it is screwed into a corresponding dowel 48 which has previously been anchored in the rail substructure 18.

The intermediate layer 20 is slidingly supported on a thin face plate 50 which has downwardly crimped holes 52 for the bolts 16 to pass through. The face plate 50 is centered on the central axes of the dowels 48 by the downwardly crimped edges of the holes 52.

The rail 10 may for example be installed as follows.

At first, the rail bed, which forms the complete rail substructure 18 in this embodiment, is concreted. The dowels 48 have a very coarse external thread and are screwed into the still wet concrete of the rail bed, so that they are firmly anchored in the rail bed after the concrete has hardened, as has been described in applicant's patent application DE 100 54 041. Then, the face plate 50, the intermediate layer 20 and the ribbed plate 14 are laid onto the rail bed and are provisionally fixed by means of the bolts 16. Then, the rails 10 are laid.

The hammerhead bolts 24 are hooked into the perforations 36 of the ribs 22 from the respective outer side of the rib, and the clamping springs 26 are biased against the rail base 12 by means of the nuts 30. The rail 10 is measured thereafter, and, if necessary, the lateral position is adjusted by means of the eccentrics 32. Then, the bolts 16 are firmly tightened in order to finally fix the rail 10 on the rail substructure 18.

The embodiment example described above may be modified in various ways. For example, the intermediate layer 20 may also be formed in one piece with the lining 42 and may be molded to the ribbed plate 14.

While the anchoring sites for the hammerhead bolts 24 are integrated in the ribs 22 in the shown example, these anchoring sites may also be formed separately on the ribbed plate. Since the ribbed plate is manufactured by deep-drawing, this may be achieved without substantial manufacturing work.

In place of the hammerhead bolts 24, other fastening means may be provided for fastening the clamping springs 26, for example threaded bolts which are inserted or screwed into drawn bushings of the ribbed plate 14. In the latter case, it is only necessary to cut a thread into the bushings.

In another embodiment, the hammerhead bolts 24 are replaced by bolts with normal heads or by hammerhead bolts that are inserted through corresponding openings of the ribbed plate 14 from below, before the lining 42 is molded in the interior of the ribbed plate. The head of the bolts may thereby be embedded in the lining 42, or holes may be left open in the lining 42, through which the bolts may be inserted from below in a later step.

Figure 4:
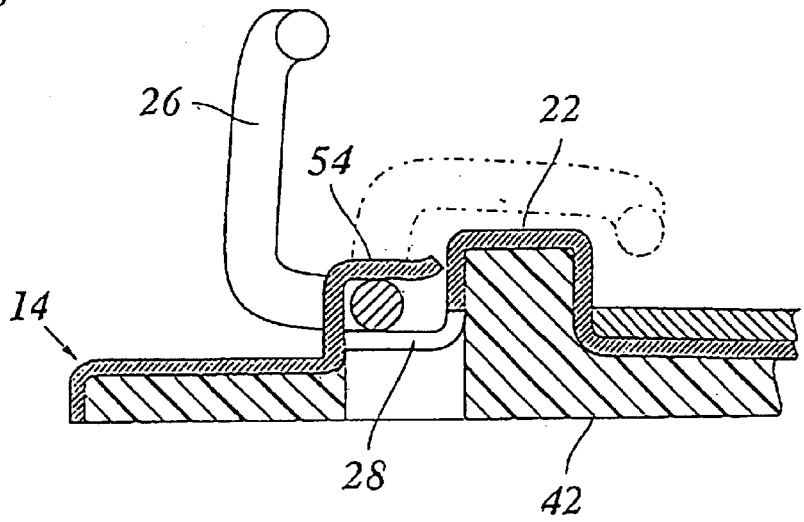
FIGS. 4 and 5 are sectional views of parts of ribbed plates according to other embodiment examples.
Figure 5:
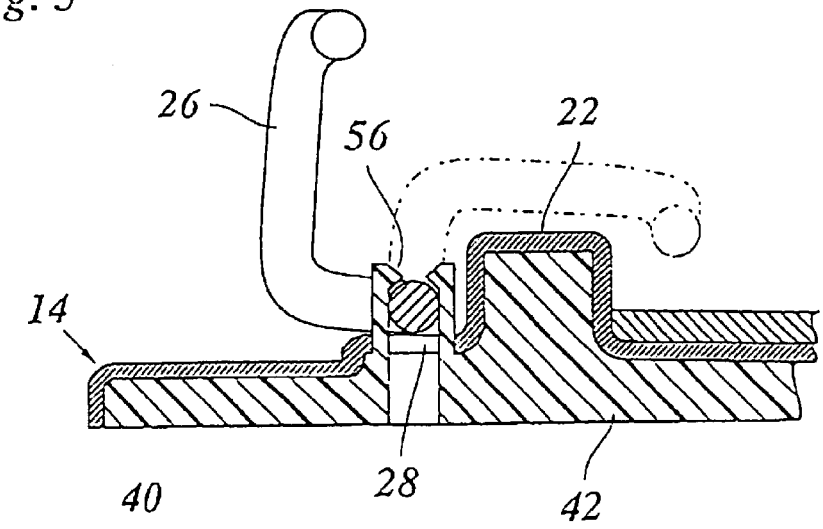

FIGS. 4 and 5 show an embodiment of the ribbed plate 14 in which it is possible to provisionally fix the clamping springs 26 at the rib plate before the rail 10 is laid, so that the ribbed plate may be delivered with pre-mounted clamping springs.

In the embodiment shown in FIG. 4, holding springs 54 are to this end provided in the region of the platforms 28 on which the clamping springs 26 are supported, the holding springs 54 being pressed out of the rib plate 14 and gripping over a lower leg of the clamping spring, so that the clamping spring is clampingly held in position. In the condition in which it is delivered, the clamping spring 26 is tilted back, as has been shown in solid lines in FIG. 4, so that the laying of the rail 10 is not obstructed. For fixing the rail, it is then sufficient to tilt the clamping spring onto the rail base 12 and to tighten it by means of the nut 30.

In the embodiment shown in FIG. 5, the holding springs 54 have been replaced by elastic tongues 56 which are molded in one piece with the lining 42 and project upwardly through holes in the platform 28.

In another embodiment, it is also possible to mold a plastic member which forms the elastic tongues 56 or similar fastening means in one process with the inlay 44 on the top side of the ribbed plate 14.

What is claimed is:

1. Fixing device for railway rails, comprising a ribbed plate for supporting a rail and which is adapted to be fixed on a rail substructure, the ribbed plate having ribs between which the rail is accommodated with a rail base thereof, wherein the ribbed plate is a drawn sheet member, the ribbed plate being shaped as a deep-drawn, downwardly open shell and the shell-shaped ribbed plate, including the ribs, being filled with a lower lining of a vibration absorbing material.

2. Fixing device according to claim 1, wherein the lining is molded to the ribbed plate.

3. Fixing device according to claim 1, wherein the ribbed plate is supported on a vibration absorbing intermediate layer which is formed in one piece with the lining.

4. Fixing device according to claim 1, further comprising a vibration absorbing inlay molded to the ribbed plate on a top side thereof between the ribs.

5. Fixing device according to claim 1, wherein the ribs are formed as truncated pyramid-shaped protuberances pressed-out upwardly out of the ribbed plate.

6. Fixing device according to claim 1, further comprising anchoring sites for a clamping arrangement for clamping the rail base on the ribbed plate, the anchoring sites being formed by one of drawing and punching the sheet member forming the ribbed plate.

7. Fixing device according to claim 6, wherein the anchoring sites are formed in the ribs.

8. Fixing device according to claim 1, further comprising bearing bushes for accommodating eccentrics for a lateral adjustment of the rib plate, the bearing bushes being formed by drawing the sheet member forming the ribbed plate.

9. Fixing device according to claim 1, wherein the ribbed plate has a clamping arrangement for holding clamping springs, said clamping springs being held in said clamping arrangement such that the clamping springs are tiltable into a position gripping over the rail base.

10. Fixing device according to claim 9, wherein the clamping arrangement is formed by holding springs pressed out of the sheet member of the ribbed plate.

11. Fixing device according to claim 9, wherein the clamping arrangement is formed by elastic tongues which are formed in one piece with the lining of vibration absorbing material that fills the ribbed plate, and the elastic tongues project upwardly through openings in the ribbed plate.

12. Fixing device according to claim 1, wherein the vibration absorbing material is a synthetic resin.

13. Fixing device according to claim 1, wherein the ribs form hollow spaces below the ribbed plate and the lower lining of vibration absorbing material fills the hollow spaces below the ribs.

14. Fixing device according to claim 13, wherein the lower lining of vibration absorbing material has a greater thickness at positions corresponding to the ribs of the ribbed plate.

15. Fixing device according to claim 1, wherein the lower lining of vibration absorbing material has a greater thickness at positions corresponding to the ribs of the ribbed plate.

* * * * *